US010935185B2

(12) United States Patent
Brunsch

(10) Patent No.: US 10,935,185 B2
(45) Date of Patent: Mar. 2, 2021

(54) TWO-PART CONTAINER ASSEMBLY FOR COMPRESSED AIR

(71) Applicant: SAF-HOLLAND GmbH, Bessenbach (DE)

(72) Inventor: Bernd Brunsch, Dreieich (DE)

(73) Assignee: SAF-HOLLAND GmbH, Bessenbach (DE)

( * ) Notice: Subject to any disclaimer, the term of this patent is extended or adjusted under 35 U.S.C. 154(b) by 129 days.

(21) Appl. No.: 15/736,433

(22) PCT Filed: Jun. 1, 2016

(86) PCT No.: PCT/EP2016/062341

§ 371 (c)(1),
(2) Date: Dec. 14, 2017

(87) PCT Pub. No.: WO2016/202585

PCT Pub. Date: Dec. 22, 2016

(65) Prior Publication Data

US 2018/0187835 A1 Jul. 5, 2018

(30) Foreign Application Priority Data

Jun. 16, 2015 (DE) ..... 10 2015 211 011.7

(51) Int. Cl.
*F17C 1/16* (2006.01)

(52) U.S. Cl.
CPC ..... *F17C 1/16* (2013.01); *F17C 2201/0119* (2013.01); *F17C 2201/056* (2013.01);
(Continued)

(58) Field of Classification Search
CPC ..... B65D 15/24; B65D 17/12; B65D 6/28; B65D 8/04; B65D 8/06; B65D 83/38;
(Continued)

(56) References Cited

U.S. PATENT DOCUMENTS 2,753,008 A * 7/1956 Peirce ..... G05G 25/04 180/90.6
4,304,038 A * 12/1981 Yabu ..... B21D 51/2684 156/293

(Continued)

FOREIGN PATENT DOCUMENTS

CN 101133280 A 2/2008
CN 103291916 A 9/2013

(Continued)

OTHER PUBLICATIONS

European Patent Office; International Search Report; dated Sep. 20, 2016.

*Primary Examiner* — J. Gregory Pickett
*Assistant Examiner* — Tia Cox
(74) *Attorney, Agent, or Firm* — Price Heneveld LLP

(57) ABSTRACT

A container assembly, in particular of an air pressure system of a utility vehicle, includes a first region and a second region, wherein the first and the second region together enclose at least part of a container interior, wherein the first and the second region are connected to each other via a joining region, and wherein the joining region is subjected to a shearing load in the event of loading from the container interior side.

19 Claims, 2 Drawing Sheets

(52) U.S. Cl.
CPC ..... *F17C 2203/066* (2013.01); *F17C 2203/0663* (2013.01); *F17C 2209/221* (2013.01); *F17C 2209/234* (2013.01); *F17C 2221/031* (2013.01); *F17C 2223/0123* (2013.01); *F17C 2223/035* (2013.01); *F17C 2260/011* (2013.01); *F17C 2270/0171* (2013.01)

(58) Field of Classification Search
CPC ... B29C 65/00; B29C 66/122; B29C 66/1222; B29C 66/5344; B29C 66/44; B29C 66/5432; F17C 2201/0109; F17C 1/16; F17C 13/084; F16J 15/16; F16J 15/164
USPC ..... 222/215; 220/657, 562, 611–13, 581, 220/583, 662, 62.11, 62.22; 215/12.2, 215/325
See application file for complete search history.

(56) References Cited

U.S. PATENT DOCUMENTS

| | | | | | |
|---|---|---|---|---|---|
| 5,211,306 | A * | 5/1993 | Delonge-Immik | ... B60R 21/268 | 220/588 |
| 5,553,753 | A * | 9/1996 | Abplanalp | ..... B65D 11/02 | 222/387 |
| 5,996,835 | A * | 12/1999 | Farrington | ..... B65D 11/06 | 220/613 |
| 7,017,772 | B2 * | 3/2006 | Meiland | ..... B65D 83/38 | 220/612 |

FOREIGN PATENT DOCUMENTS

| | | | |
|---|---|---|---|
| DE | 2236069 | | 7/1972 |
| EP | 0434110 | | 6/1991 |
| EP | 0434110 | A2 | 6/1991 |
| EP | 0596690 | | 11/1994 |
| EP | 1850058 | | 10/2007 |
| EP | 1852647 | | 11/2007 |
| EP | 3056791 | A1 | 8/2016 |
| FR | 2706140 | | 12/1994 |
| JP | 2005155776 | | 6/2005 |
| WO | 2014139531 | | 9/2014 |

* cited by examiner

TWO-PART CONTAINER ASSEMBLY FOR COMPRESSED AIR

BACKGROUND OF THE INVENTION

The present invention relates to a container assembly, in particular a container assembly of an air pressure system of a utility vehicle, such as a trailer or semitrailer.

Container assemblies of this type serve in particular to supply the chassis of a vehicle with compressed air. In particular, storage vessels or container assemblies which can provide corresponding compressed air to a pneumatic spring or similar peripheral units are provided in this case. Vessels of this type are customarily constructed from a cylindrical housing, the ends of which are closed by closure caps. Said closure caps are butt-welded to the cylindrical housing. However, a problem in the case of containers of this type is that, because of the loadings on the weld seam, leakages frequently occur and, furthermore, the service life of the vessels is greatly reduced. Furthermore, containers of this type are often not capable of storing a gas which is under high pressure.

It is therefore the object of the present invention to provide a container assembly, in particular a container assembly of an air pressure system of a utility vehicle, such as a semitrailer or trailer, which reduces the loadings acting on the welded joint and thereby increases the service life and operational reliability and is capable of storing a gas which is under high pressure.

SUMMARY OF THE INVENTION

According to the invention, a container assembly, in particular an air pressure system of a utility vehicle, is provided, comprising a first region and a second region, wherein the first and the second region together enclose at least part of a container interior, wherein the first and the second region are connected to each other via a joining region, and wherein the joining region is subjected to a shearing load in the event of loading from the container interior side. Therefore, the container assembly particularly expediently consists of at least two separate parts, of which one part comprises the first region and the second part comprises the second region. In other words, the container assembly therefore consists during the manufacturing of two separate parts which are joined together and, in the final state, therefore form a cohesive element. The first and the second region are arranged here in such a manner that said regions together enclose at least part of a container interior. The first region and the second region are therefore advantageously part of a container which encloses a volume on all sides, and therefore the container can be pressurized. For this purpose, the first region and the second region are connected to each other via a joining region, wherein the connection of the first region and of the second region is advantageously designed in such a manner that said connection is fluid-tight, in particular gas-tight. In this case, the connection of the first and of the second region can be designed to be reversible, i.e. releasable. However, in a preferred embodiment, the first region and the second region are connected to each other irreversibly, i.e. so as not to be separable from each other without being destroyed. The joining region can therefore be defined by those regions of the first and second region which are adjacent to each other and between which a connection is provided. A particular advantage of the invention resides in the fact that the joining region is subjected to a shearing load in the event of loading from the container interior side. In other words, the joining region is designed or arranged in such a manner that, when the container is pressurized, the joining point between the first region and the second region is not or is only insubstantially subjected to a tensile load or set into tensile stress, and rather is merely or at least predominantly exposed to a shearing stress. By this means, the material loadings acting on the joining point between the first and second region can advantageously be reduced.

The first region and the second region are advantageously connected to each other in an integrally bonded manner, in particular welded or soldered. By means of the integrally bonded connection, a connection which can be particularly subjected to a load and is gas-tight can be formed between the first region and the second region. The joining region can therefore be in particular that portion of the first and second region which forms or provides an integrally bonded connection or contact between the first and second region. The integrally bonded connection can be particularly advantageously created by welding or soldering. In other words, the joining region is therefore more expediently formed or designed as a welded or soldered connection or welded or soldered region. A welded connection particularly results in a joining point between first and second region that can absorb particularly high forces.

In a preferred embodiment, the first region has a first joining portion and the second region has a second joining portion. The joining portions therefore in particular constitute those portions of the first or second region, via which an integrally bonded connection to the other region in each case is produced.

The first and the second joining portion are preferably formed substantially parallel and/or concentrically to each other. In the case of a parallel arrangement of the first and second joining portion to each other, those surfaces or the joining surfaces between which an integrally bonded connection is produced can preferably be arranged facing each other. In the case of an annular arrangement of the two joining portions with respect to each other, the circumferential surfaces (i.e. inner circumferential surface of the outer region and outer circumferential surface of the inner region) are therefore joined to each other. "Substantially parallel" should be understood here in particular as meaning that deviations of plus/minus 5°, preferably plus/minus 3° from the parallel axis are also included. In addition or alternatively thereto, those surfaces of the joining regions (i.e. the joining surfaces) on which the material bond is present may also constitute end-side surfaces of the respective joining portions, which surfaces are therefore advantageously not directed toward each other, but rather are substantially oriented in the same direction. "Substantially oriented in the same direction" also signifies here that the end-side surfaces of the joining regions do not have to be exactly parallel to each other, but rather can likewise have a certain inclination with respect to each other, the inclination lying in the region of plus/minus 5°, in particular plus/minus 3°. In the case of a concentric arrangement of the joining portions with respect to each other, the first joining portion—starting from a center line of symmetry of the container assembly—lies radially outside the second joining portion or, in an alternative embodiment, the second joining portion lies radially outside the first joining portion.

Expediently, at least the second joining portion is oriented toward a container outer side. It is thus preferred that the second joining portion is directed in its geometrical extent toward a container outer side. In this context, when the joining point is formed on the end side of the respective joining region, the respective end side is then also oriented toward the container outer side. In the case of a joining point which extends in the circumferential direction, only the joining surface of the second joining portion is oriented toward the container outer side while the joining surface of the first region is oriented toward the container inner side.

In an advantageous manner, the second joining portion encloses the first joining portion. In other words, the first joining portion and the second joining portion can therefore be arranged concentrically to each other in such a manner that the second joining portion encloses the first joining portion. As seen in a radial direction, the second joining portion is therefore arranged outside the first joining portion. It is particularly preferred in this connection that the joining surface of the second joining portion is oriented toward the container interior side.

In an alternative embodiment, the first joining portion can enclose the second joining portion. Analogously to the embodiment described above, the two joining portions are therefore advantageously formed concentrically to each other, wherein, as seen in a radial direction, the first joining portion is arranged outside the second joining portion.

Expediently, a portion of the second region adjacent to the second joining portion is provided, wherein the adjacent portion is oriented transversely with respect to the second joining portion. In other words, a portion of the second region adjacent to the joining point between first and second region is therefore provided, said portion extending transversely with respect to the extent of the second joining portion, in particular transversely with respect to the extent of the second joining surface.

Advantageously, the second joining portion and the portion adjacent thereto are at an angle of between 65° and 115°, advantageously 75° and 105° and particularly preferably 85° and 95° to each other. It can thus be expedient if, in the case of an arrangement in which the first joining portion lies radially outside the second joining portion, the second joining portion and the portion adjacent thereto enclose an angle—as measured from the container outer side—which is between 25° and 110°, preferably between 45° and 100° and particularly preferably between 70° and 95°. It is thereby ensured that, when the container is pressurized, there is no or only an insubstantial force component which acts on the joining point in such a manner that the first joining portion and the second joining portion are forced radially away from each other. In a design of the container assembly, in which the second joining portion is arranged radially outside the first joining portion, it is particularly preferred if the second joining portion and the portion adjacent thereto enclose an angle—as measured from the container inner side—which is between 25° and 110°, preferably between 45° and 100° and particularly preferably between 70° and 95°. This ensures that, in the event of pressurization, the second joining portion is pressed radially inward onto the first joining portion, as a result of which a particularly tight connection at the joining point is ensured.

In an advantageous manner, the wall thickness of the first region and/or second region is increased in the region of the joining portion. The increase is dimensioned in such a manner that the wall thickness of the first region and/or second region is greater or is increased in the respective joining portion with respect to an average or averaged wall thickness of the remaining part of the respective region. It can be advantageous if only one of the joining portions has an increased wall thickness. However, the two joining portions are particularly advantageously formed with an increased wall thickness. It is thereby ensured that the joining point between the two regions can be securely and reliably produced.

In an advantageous embodiment, the ratio of the increase of the wall thickness of the first joining portion to an increase of the wall thickness of the second joining portion is 0.7 to 1.8, preferably between 0.9 to 1.5 and particularly preferably between 0.95 to 1.3. It is also possible that the ratio has a lower value of at least 1.03, preferably 1.08. This ensures that the forces acting on the two joining portions in the event of pressurization of the container are optimally transmitted in order to ensure as uniform a loading of the joining point as possible.

In an advantageous manner, the wall thickness of the first region is greater than that of the second region. In other words, the first region has a wall thickness which is averaged or average over the entire extent and is greater than that of the second region. This is particularly advantageous since it has turned out that, in the case of cylindrical vessels, the circumferential surface is exposed to a greater loading than the respective end surfaces.

It is particularly expedient that the first region forms at least one, preferably radially encircling, part of a preferably cylindrical circumferential wall of the container. In other words, the container can therefore be designed as a geometrical body which has an extensive or circumferential wall which particularly expediently corresponds to the lateral surface of a cylinder. The corresponding ends of said hollow-cylindrical first region, which are therefore provided at the ends thereof, can be closed by a second region in each case, and therefore the second region forms a base or cover of the container.

In an advantageous manner, the second region is designed to be at least partially concave or convex. In the case of a concave configuration of the second region, the latter is at least partially bent toward the container interior side. This configuration is particularly advantageous when, in the case of a radial arrangement of the two joining portions, the first joining portion radially encloses the second joining portion. When the container is pressurized, upon deformation of the concave region the second joining portion is therefore pressed radially outward against the first joining portion, as a result of which the operational safety of the container assembly can be increased. In a corresponding manner, a convex design of the second region, in which the convex region therefore projects toward the container outer side, is particularly advantageous if the second joining portion encloses the first joining portion in the radial direction since, in the event of pressurization of the second region, the second joining portion is pressed radially inward onto the first joining portion. It goes without saying that it is not the entire second region which is designed to be concave or convex, but rather merely at maximum that portion of the second region which does not form the second joining portion, wherein the concave or convex region can also extend only over part of the above-defined portion.

In a preferred embodiment, the first and/or the second region are/is formed from a plastic. Materials, such as PVC, etc., which are particularly readily weldable to one another, are particulary suitable for this purpose, as a result of which a particularly good integrally bonded connection can be produced. It goes without saying that other materials or composite materials, such as, for example, laminates made from carbon fiber and/or glass fiber-resin bonds, can also be provided.

BRIEF DESCRIPTION OF THE DRAWINGS

Further properties and features of preferred embodiments of the present invention emerge from the description below of preferred embodiments with reference to the attached figures, wherein individual features of embodiments can be combined with one another to form new embodiments. In the figures.

DETAILED DESCRIPTION OF THE PREFERRED EMBODIMENTS

Figure 1:
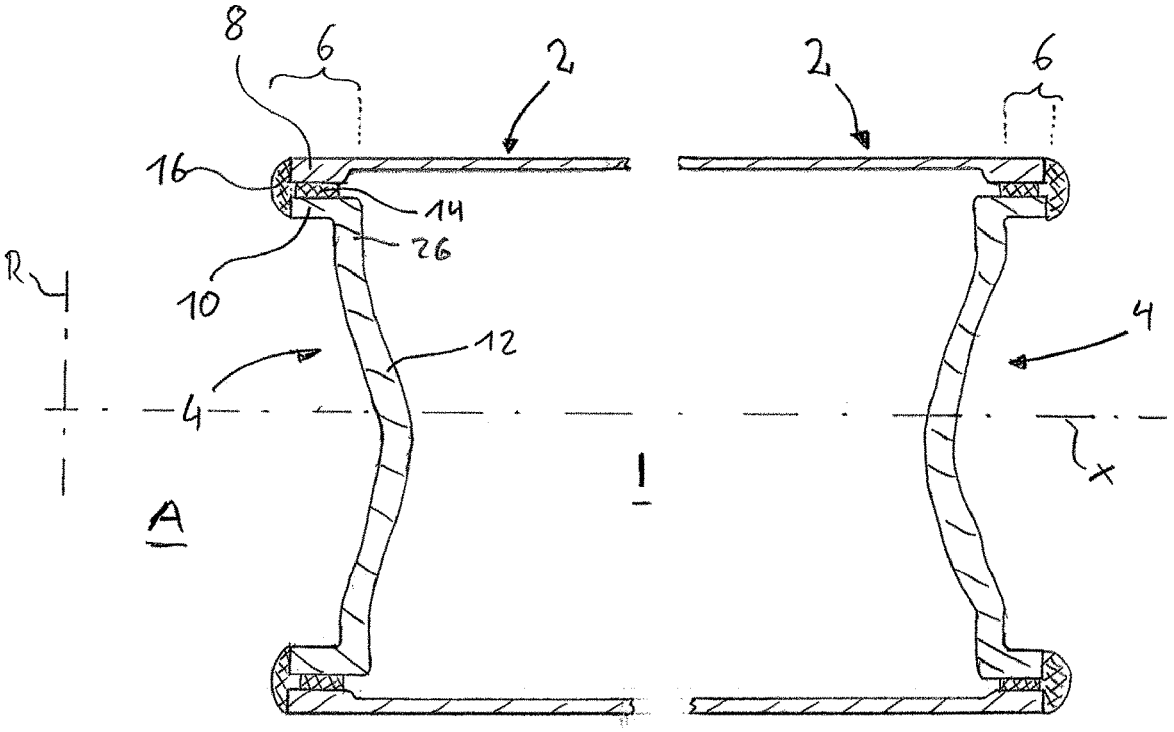
FIG. 1 shows a cross-sectional view of a first embodiment of the container assembly.

FIG. 1 illustrates a cross-sectional view of a first preferred embodiment of the container assembly according to the invention. The latter is expediently designed to be substantially rotationally symmetrical about an axis of symmetry X and has a first region 2 and a second region 4. The first region 2 is designed here in such a manner that said region substantially corresponds to a lateral surface of a cylinder. The second region 4 is arranged here on the first region 2 in such a manner that said second region forms a base or cover, and therefore the first region 2 and the second region 4 enclose a container interior I and separate the latter from a container exterior or container outer side A.

The first region 2 and the second region 4 are connected to each other via an adjoining region 6. For this purpose, the first region 2 has a first joining portion 8. The second region 4 correspondingly has a second joining portion 10.

In the embodiment illustrated, the second region 4 has a concave portion 12 which is curved toward the container interior I.

As is apparent, the first joining portion 8 encloses the second joining portion 10 in a radial direction R, and therefore—as seen in the radial direction R—the first joining portion 8 is arranged outside the second joining portion 10.

Figure 2:
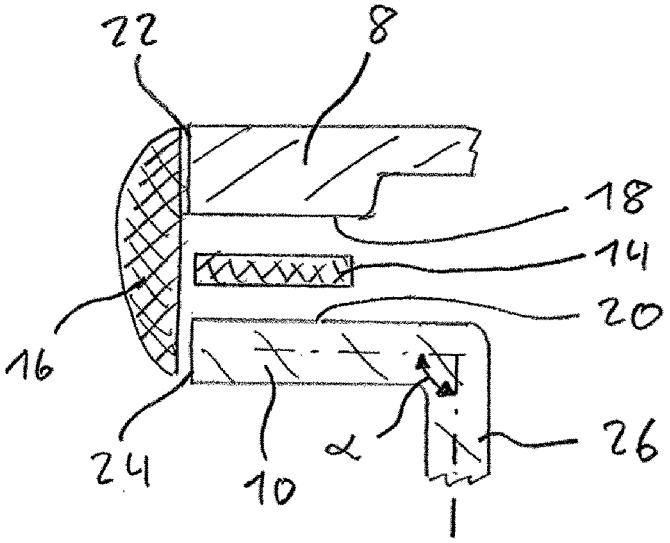
FIG. 2 shows an exploded illustration of a sectioned partial view of the first embodiment of the invention.

FIG. 2 illustrates an enlarged cross-sectional view of the joining region 6. In this case, the first region 2 is connected to the second region 4 both via a circumferential joining point 14 and via an end-side joining point 16. It goes without saying that also only one of the joining points 14, 16 can be provided. In order to provide the circumferential joining point, the first joining portion 8 has a circumferential joining surface 18 opposite which and particularly advantageously parallel to which the second region 4 has a second circumferential joining surface 20. As a result, the circumferential joining point 14 forms a rotationally symmetrical ring about the axis of symmetry X.

In order to form the end-side joining point 16, the first joining portion 8 has a first end-side joining surface 22. In a corresponding manner, the second joining portion 10 has a second end-side joining surface 24. In the embodiment illustrated, the end-side joining surfaces 22, 24 are formed substantially parallel to each other. It goes without saying that said joining surfaces, however, can also be at an angle to each other which can advantageously be plus/minus 5° to the parallel or radial R.

The second joining portion 10 is adjoined by an adjacent portion 26 which is formed transversely with respect to the second joining portion 10. In a preferred embodiment, the second joining portion 10 is at an angle $\alpha$ of between 45° and 110°—as measured from the container outer side A—to the adjacent portion 26.

Figure 3:
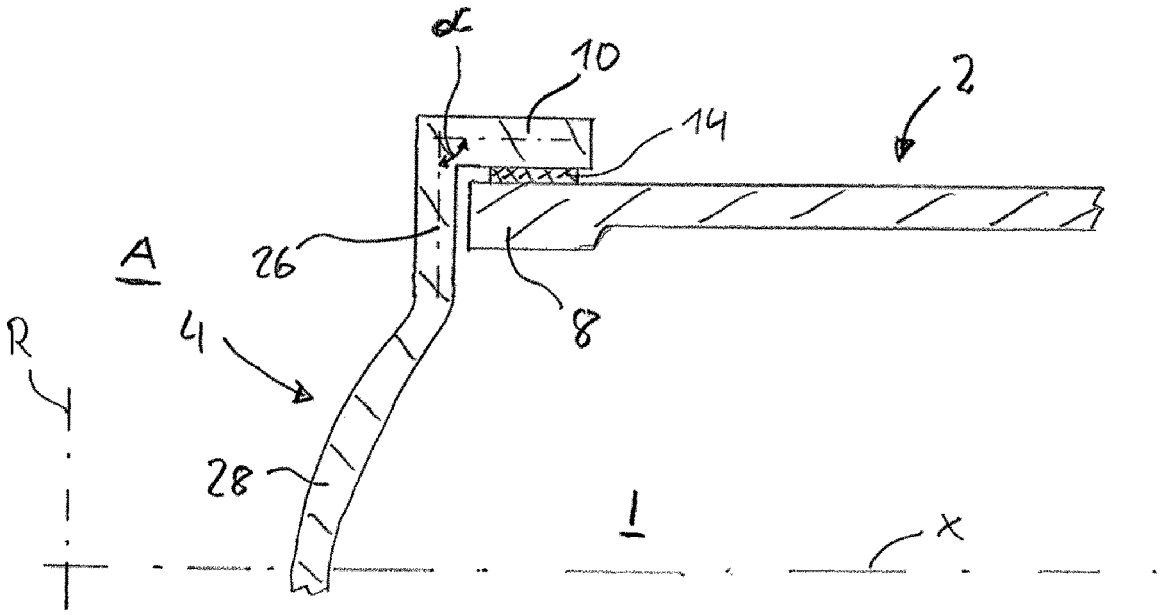
FIG. 3 shows a sectioned partial view of a further embodiment of the invention.

FIG. 3 illustrates a partial cross-sectional view of a further embodiment of the container assembly according to the invention. In contrast to the embodiment illustrated in FIG. 1, the second joining portion 10 encloses the first joining portion 8, i.e. is arranged outside the first joining portion 10, as seen in the radial direction R. Furthermore, only one circumferential joining point 14 is provided. Outside the second joining portion 10 and the adjacent portion 26, the second region 4 is formed with a convex portion 28 which is curved outward toward a container outer side A.

In the illustrated embodiment, the wall thickness of the first region 2 and of the second region 4 of the respective joining portion 8, 10 is of increased design. It is particularly advantageous if the increase of the wall thickness of the first joining portion takes place in a direction which lies opposite the second joining portion 10, and therefore the first circumferential joining surface 18 is substantially aligned with the adjoining circumferential surface of the first region 2. In the case of a circular-cylindrical configuration, the radius of the circumferential surface on which the first circumferential joining surface 18 is provided would thus be substantially constant along the axis of symmetry X.

LIST OF REFERENCE SIGNS

2 First region
4 Second region
6 Joining region
8 First joining portion
10 Second joining portion
12 Concave portion
14 Circumferential joining point
16 End-side joining point
18 First circumferential joining surface
20 Second circumferential joining surface
22 First end-side joining surface
24 Second end-side joining surface
26 Adjacent portion
28 Convex portion
A Container outer side
I Container inner side
R Radial direction
X Axis of symmetry
$\alpha$ Angle

The invention claimed is:

1. A container assembly of an air pressure system configured for use within a utility vehicle, comprising:
- a first region having a first wall thickness; and
- a second region having a second wall thickness;
- wherein the first and the second regions together enclose at least part of a container interior;
- wherein the first and the second regions are connected to each other via a joining region; and
- wherein the joining region is subjected to a shearing load in the event of loading from the container interior;
- wherein the first wall thickness and/or the second wall thickness is increased in the region of the joining portion; and
- wherein the first and second regions are at least one of welded or soldered to one another to withstand an air pressure within the air pressure system of the utility vehicle.

2. The container assembly as claimed in claim 1, wherein the first and second regions are integrally bonded to each other.

3. The container assembly as claimed in claim 1, wherein the first region has a first joining portion and the second region has a second joining portion.

4. The container assembly as claimed in claim 3, wherein the first and second joining portions are at least one of substantially parallel or concentric to each other.

5. The container assembly as claimed in claim 3, wherein at least the second joining portion is oriented toward a container outer side.

6. The container assembly as claimed in claim 3, wherein the second joining portion encloses the first joining portion.

7. The container assembly as claimed in claim 3, wherein the first joining portion encloses the second joining portion, and wherein the joining portions are concentric to each other.

8. The container assembly as claimed in claim 3, wherein a portion of the second region adjacent to the second joining portion is oriented transversely with respect to the second joining portion.

9. The container assembly as claimed in claim 8, wherein the second joining portion and the portion adjacent the second joining portion enclose an angle as measured from the container outer side which is between 25° and 110°.

10. The container assembly as claimed in claim 9, wherein the angle is between 45° and 100°.

11. The container assembly as claimed in claim 10, wherein the angle is between 70° and 95°.

12. The container assembly as claimed in claim 1, wherein a ratio of the increase of the wall thickness of the first joining portion to the increase of the wall thickness of the second joining portion is between 0.7 to 1.8.

13. The container assembly as claimed in claim 12, wherein the ratio is between 0.9 to 1.5.

14. The container assembly as claimed in claim 13, wherein the ratio is between 0.95 to 1.3.

15. The container assembly as claimed in claim 1, wherein the wall thickness of the first region is greater than that of the second region.

16. The container assembly as claimed in claim 1, wherein the first region includes at least one radially encircling part of a cylindrical circumferential wall.

17. The container assembly as claimed in claim 1, wherein the second region is at least one of partially concave or partially convex.

18. The container assembly as claimed in claim 1, wherein the first region and the second region each comprises plastic.

19. The container assembly as claimed in claim 4, wherein the first and second joining portions are substantially parallel and concentric with one another.

* * * * *